United States Patent [19]

Takahashi et al.

[11] Patent Number: 4,820,232

[45] Date of Patent: Apr. 11, 1989

[54] VOICE MAKING DEVICE FOR MOVING ANIMAL TOY AND MOVING ANIMAL TOY USING THE VOICE MAKING DEVICE

[75] Inventors: Hajime Takahashi; Eiichi Maeda, both of Tokyo, Japan

[73] Assignee: Iwaya Corporation, Tokyo, Japan

[21] Appl. No.: 196,683

[22] Filed: May 20, 1988

[30] Foreign Application Priority Data

Dec. 4, 1987 [JP] Japan ..... 62-307022

[51] Int. Cl.[4] ..... A63H 33/40; A63H 3/31; A63H 3/28; A63H 3/22

[52] U.S. Cl. ..... 446/178; 446/194; 446/298; 446/356

[58] Field of Search ..... 446/178, 188, 192, 194, 446/195, 196, 207, 208, 216, 297, 298, 300, 301, 303, 352, 355, 356

[56] References Cited

U.S. PATENT DOCUMENTS

| | | | |
|---|---|---|---|
| 1,497,651 | 6/1924 | Benes | 446/195 |
| 1,542,542 | 6/1925 | Echevarria | 446/178 X |
| 1,608,142 | 11/1926 | Stephenson | 446/195 X |
| 2,076,145 | 4/1937 | Hall | 446/178 |
| 2,143,513 | 1/1939 | Giaimo | 446/178 |
| 2,348,250 | 5/1944 | Gardner et al. | 446/178 X |
| 4,185,533 | 1/1980 | Akiyama et al. | 446/194 X |
| 4,245,515 | 1/1981 | Iwaya | 446/356 X |
| 4,318,242 | 3/1982 | Pin-Houng | 446/178 |

FOREIGN PATENT DOCUMENTS

| | | | |
|---|---|---|---|
| 61-24309 | 6/1986 | Japan | 446/188 |
| 1556571 | 11/1979 | United Kingdom | 446/178 |

*Primary Examiner*—Robert A. Hafer
*Assistant Examiner*—D. Neal Muir
*Attorney, Agent, or Firm*—James E. Nilles

[57] ABSTRACT

A voice making device for a moving animal toy, wherein an air is drawn in by a fan through air suction slits and delivered to a voice generating member with a vibrating piece through an air flow controlling cock, and the air suction slits are opened and closed by communication holes and blocking portions of an adjust plate, the cock and the adjust plate being actuated according to the motion of the moving animal toy. A moving animal toy using a voice making device, wherein a head, upper and lower jaws are mounted oscillatably and a voice making device is actuated by the indivisual motion of the head, upper and lower jaws to produce a sound with a specific tone.

2 Claims, 6 Drawing Sheets

VOICE MAKING DEVICE FOR MOVING ANIMAL TOY AND MOVING ANIMAL TOY USING THE VOICE MAKING DEVICE

BACKGROUND OF THE INVENTION

1. Field of the Invention

The present invention relates to a voice making device for moving animal toys and to a moving animal toy with the voice making device.

2. Description of the Prior Art

The voice making devices that have been used on the moving animal toys commonly employ a construction in which a whistle is attached to an end of a bellows-like expandable member which is pressed to blow the whistle with an air being pushed out.

Another known structure for the voice making device, as proposed in the Japanese Utility Model Publication No. 21104/1986, consists of a container secured to a toy frame; a voice generating member having a whistle; a bellows-like expandable member connected, together with the voice generating member, to the container; a vibrating member connected to the expandable member to expand and contract the expandable member; and a vertically movable control piece for opening and closing the voice generating member.

The conventional voice making device made up of the above expandable member and the whistle has a drawback. A specific sound is produced by the contraction of the expandable member and since this sound is produced by a certain amount of air flow, its tone, quality and intensity are always the same. Thus, the toy can only produce a monotonous sound failing to arouse an interest for the user. Moreover, depending on the construction of the toy, the sound produced may not match the toy.

As to the construction proposed in the preceding Japanese Publication in which a specific sound is produced by raising the control piece to open the voice generating member. Since the sound remains the same at all times in quality and intensity, as with the preceding example, the toy can only produce a monotonous sound intermittently and lacks any interesting feature. Also, depending on the type of the toy, the sound produced may not match the toy.

SUMMARY OF THE INVENTION

An object of this invention is to provide a voice making device that can produce a complex sound characteristic of the sheep's baaing by changing the sound intensity and quality by varying an air flow supplied into the device.

Another object of this invention is to provide an interesting moving animal toy with a voice making device that oscillates its head up and down n time to the changing tone of a voice produced by the voice making device while at the same time opening and closing its mouth.

The voice making device for the moving animal toy according to this invention comprises: an air blower having a fan rotatably installed in a blower chamber with air suction slits, the air blower also having a voice generating member with a vibrating piece, installed in an exhaust portion of an exhaust passage communicating with the blower chamber; a cock rotatably installed between the blower chamber and the exhaust passage to control an air flow supplied to the voice generating member; and an adjust plate installed movable with respect to the air suction slits of the blower chamber, the adjust plate having communicating holes and blocking portions to open and close the air suction slits and thereby regulate an amount of external air drawn into the blower chamber.

The moving animal toy according to this invention comprises: a body frame; a head frame mounted vertically and oscillatably at the front end of the body frame through a support shaft; a lower jaw frame mounted vertically and oscillatably on the support shaft to cooperate with an upper jaw of the head frame; the body frame, the head frame and the lower jaw frame constituting a toy body; a mechanism frame installed in the body frame of the toy body; an air blower mounted to the mechanism frame and consisting of a fan and a voice generating member, the fan being rotatably mounted in a blower chamber having air suction slits, and the voice generating member having a vibration piece in an exhaust portion of an exhaust passage communicating with the blower chamber; a cock rotatably installed between the blower chamber and the exhaust passage to control an air flow supplied to the voice generating member; an adjust plate installed movable with respect to the air suction slits of the blower chamber, the adjust plate having communicating holes and blocking portions to open and close the air suction slits and thereby regulate an amount of external air drawn into the blower chamber; a first crankshaft mounted rotatable on the mechanism frame to vertically oscillate the head frame through a connecting rod and also to rotate the cock through an actuating rod; a second crankshaft rotatably mounted on the mechanism frame to advance and retract the adjust plate; a third crankshaft rotatably mounted on the mechanism frame to vertically oscillate the lower jaw frame at small pitches; and a motor rigidly mounted to the mechanism frame and having the fan secured to one end of its output shaft, the other end of the motor output shaft being in mesh with a gear mechanism to drive the first, second and third crankshafts.

In the voice making device for the moving animal toy according to this invention, as the fan is started, the air is drawn in by the fan through the air suction slits of the blower chamber and delivered from the blower chamber through the communicating hole of the cock to the exhaust passage where the air flow activates the voice generating member to produce a sound with a specific tone.

When the external air is drawn in by the fan, the air suction slits of the blower chamber are opened and closed by the communication holes and the blocking portions of the adjust plate which is advanced and retracted, thereby automatically regulating the air flow that is taken into the blower chamber and supplied to the exhaust passage.

When the air is supplied from the blower chamber to the exhaust passage, the cock is rotated to open and close the communication hole of the cock, bringing the blower chamber into and out of communication with the exhaust passage. That is, when the cock is turned to a position where its communication hole is aligned with the air flow direction, the communication hole is opened to the exhaust passage. When it is turned so that its communication hole is directed perpendicular to the air flow direction, the communication hole is closed to the exhaust passage. Since the air flow to the voice generating member is automatically regulated by the cock rotation, the sound generated changes its magnitude and quality.

Moreover, when the voice generating member produces a sound, the vibrating piece is automatically vibrated to give a good vibration to the voice generated by the voice generating member.

In the moving animal toy of this invention, the motor drives the pinion and the fan. The rotation of the pinion is transmitted to the first, second and third crankshafts through the gear mechanism.

The rotation of the first crankshaft oscillates the connecting rod back and forth, causing the head frame and therefore its face to oscillate slowly up and down about the support shaft.

As the third crankshaft is rotated at a higher speed, the lower jaw frame is oscillated up and down about the support shaft at a higher speed than the head frame's oscillation speed.

The slower rotation of the first crankshaft 1 results in the head frame slowly moving its face up and down. The quicker rotation of the third crankshaft results in the lower jaw vibrating up and down at small pitches to cooperate with the upper jaw. The combination of the slow vertical head frame movement and the rapid vibration of the lower jaw makes the toy sheep look as if the real sheep were vibrating its mouth while moving its face up and down.

As the first crankshaft is rotated, the actuating rod is longitudinally oscillated at the same time the connecting rod is longitudinally oscillated. The longitudinal oscillation of the actuating rod causes the cock to be reciprocally turned through a specified angle bringing the communicating hole of the cock into and out of communication with the exhaust passage.

When the second crankshaft is rotated, the adjust plate is slid back and forth, opening and closing the air suction slits of the blower chamber by the communication holes and the blocking portions of the adjust plate.

Then, as the fan is driven by the motor, the external air drawn into the blower chamber by the fan through the air suction slits is supplied to the exhaust passage through the communication hole of the cock. The air flow thus supplied activates the voice generating member in the exhaust passage which produces a voice with a specific tone and intensity. When the outer air is drawn in, the air suction slits of the blower chamber are opened and closed by the communication holes and the blocking portions of the adjust plate that is slid back and forth by the rotating second crankshaft. Hence, the air flow drawn into the blower chamber and delivered to the exhaust passage is automatically regulated.

When the air is delivered from the blower chamber to the exhaust passage, the cock is reciprocally turned by the first crankshaft through the actuating rod. When the cock is turned to a position where its communication hole is aligned with the air flow direction, the communication hole is opened to the exhaust passage. When it is turned so that its communication hole is directed perpendicular to the air flow direction, the communication hole is closed to the exhaust passage. This reciprocal rotation of the cock automatically regulates the amount of air supplied to the voice generating member, making it possible to change the amplitude and quality of the voice produced by the voice generating member.

As the voice generating member produces a voice, the vibrating piece is automatically vibrated to give a vibration to the voice produced by the voice generating member. Therefore, the amplitude and quality of the sound generated by the voice generating member are changed according to the air flow into the voice generating member which is regulated by the cock rotation. At the same time, the voice with changing tones is given a vibration to make the voice sound very much like the one of a real sheep.

These and other objects and features will be described by referring to the attached drawings.

DETAILED DESCRIPTION OF THE EMBODIMENT

Figure 2:
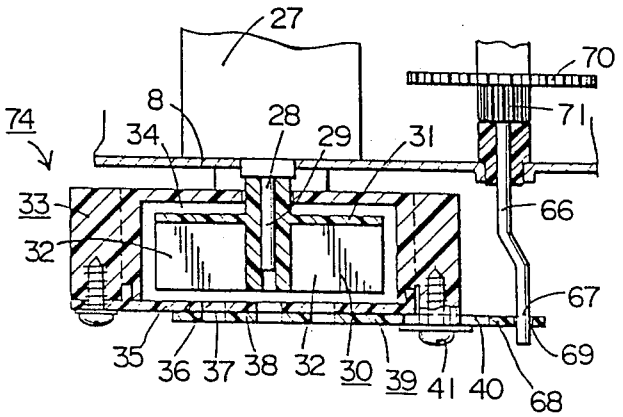
FIG. 2 is a cross section of an air blowing mechanism for the device.
Figure 1:
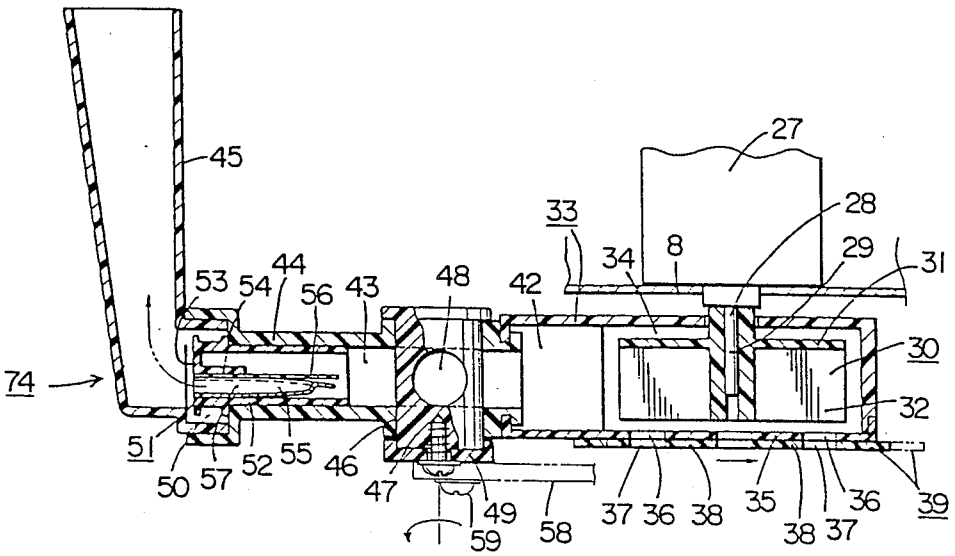
FIG. 1 is a cross section of a voice making device of this invention.
Figure 3:
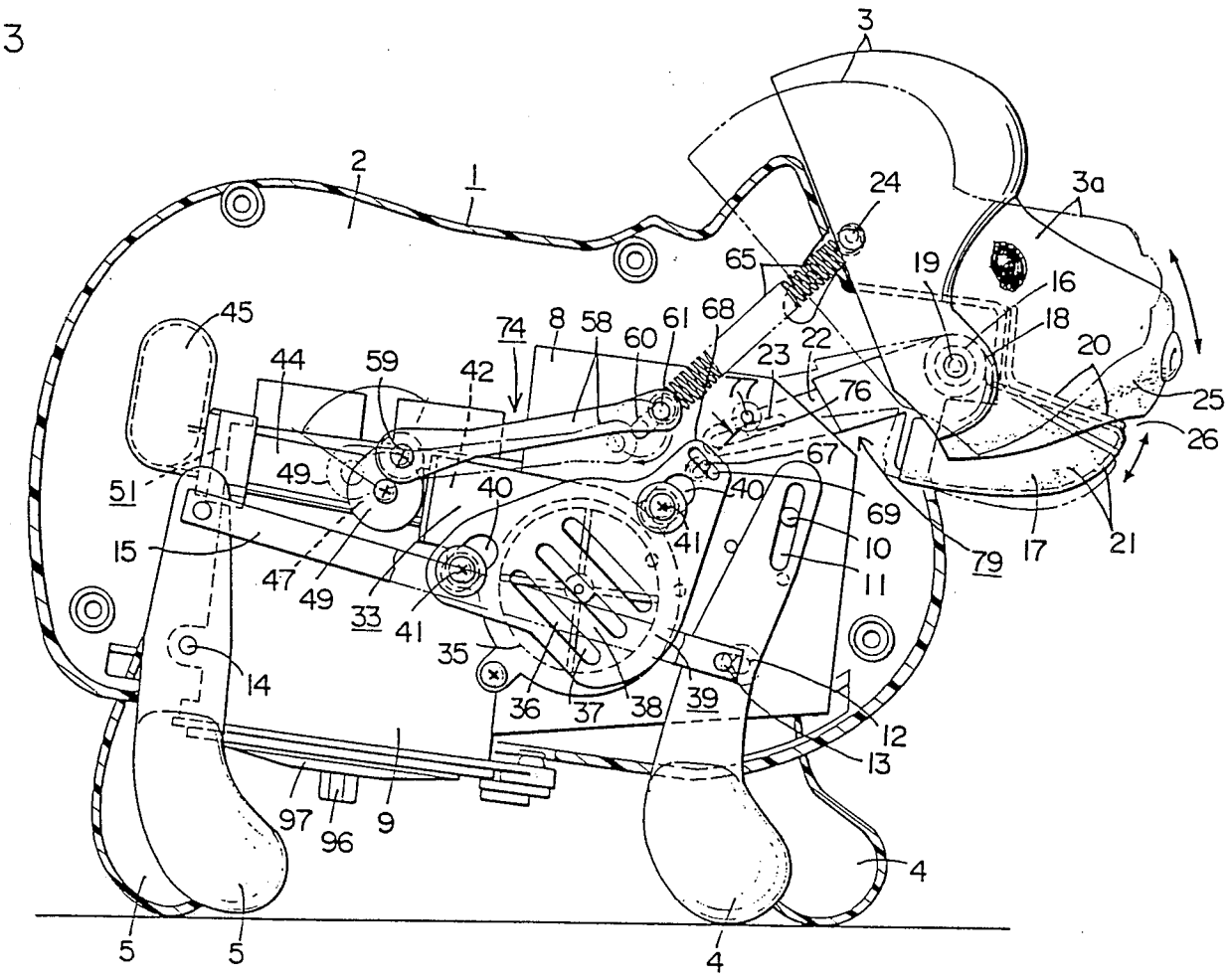
FIG. 3 is a side view, from one side, of a toy using the above voice making device.
Figure 4:
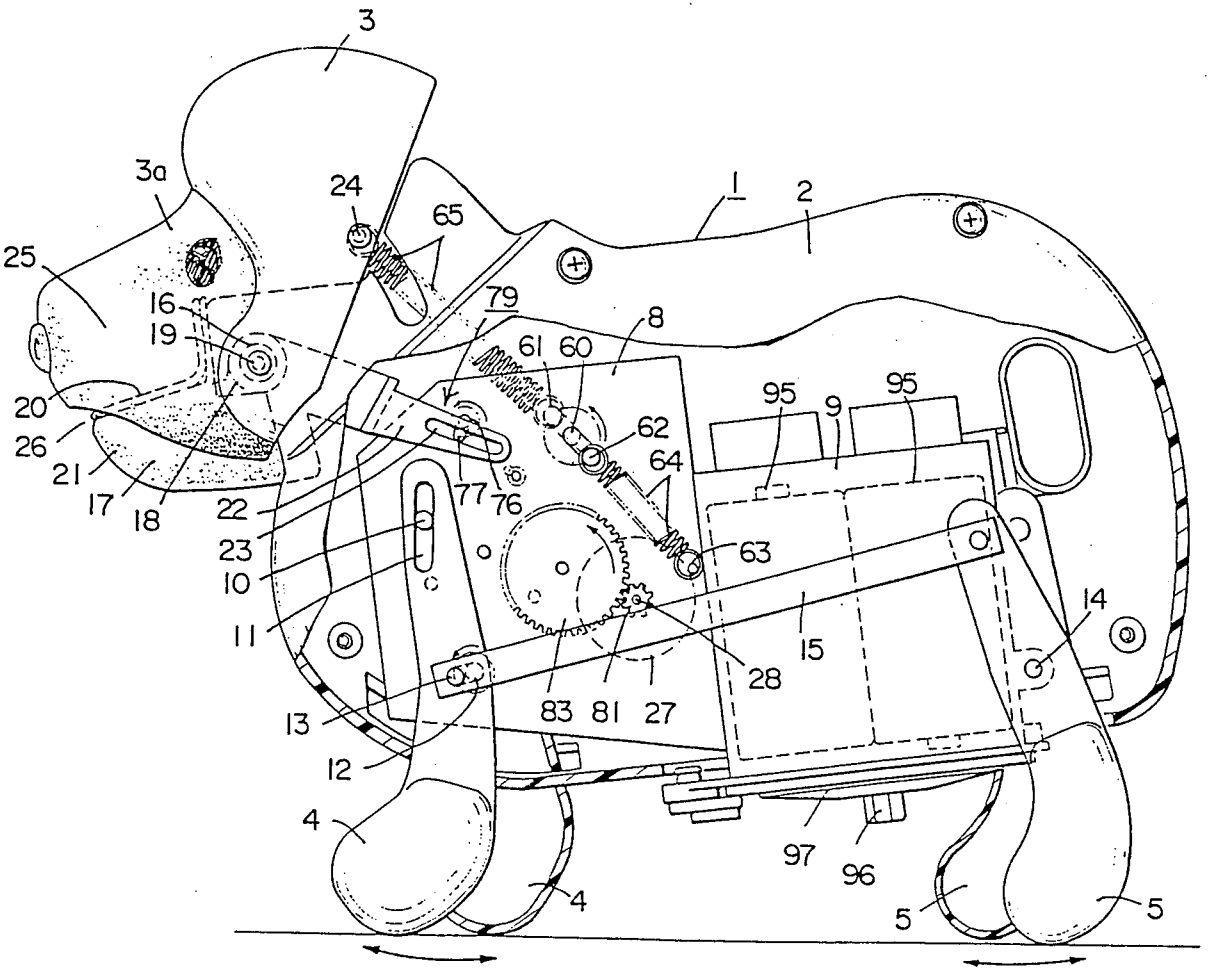
FIG. 4 is a side view, from the other side, of the toy of FIG. 3.
Figure 5:
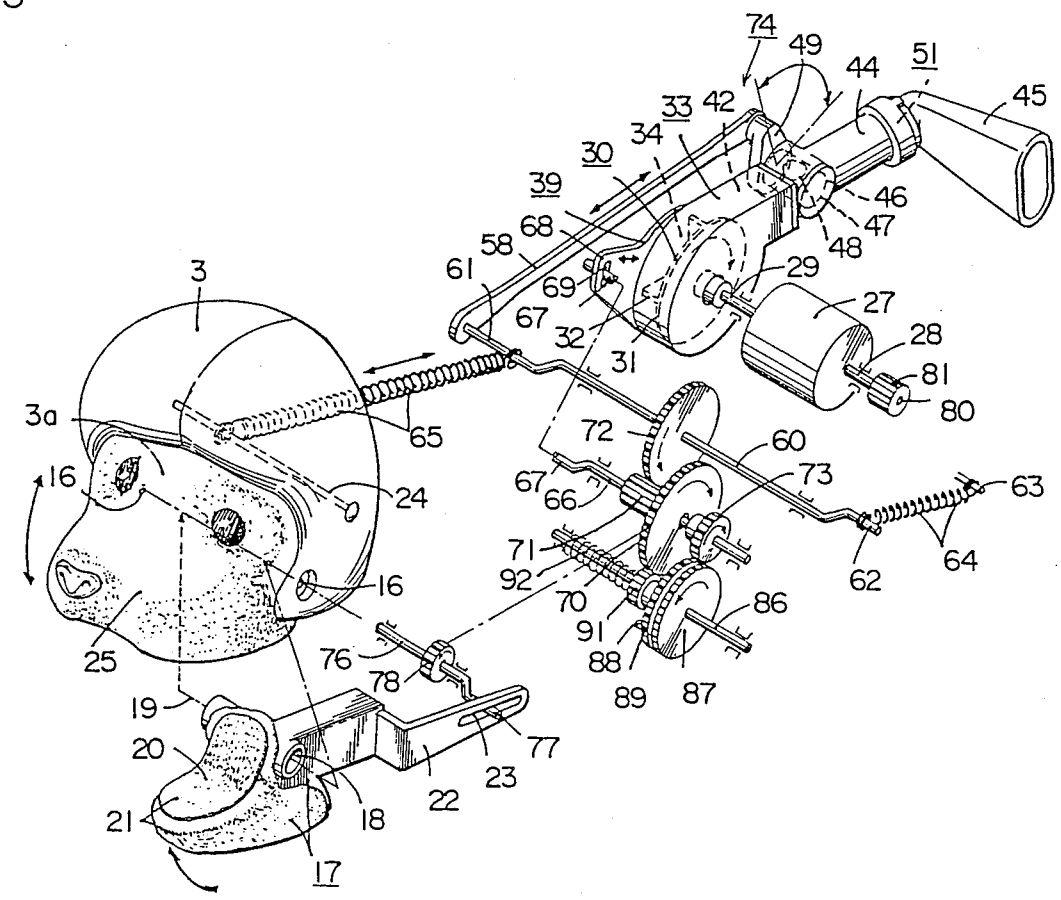
FIG. 5 is an exploded perspective view of the voice making device and a head frame drive mechanism of the toy.
Figure 7:
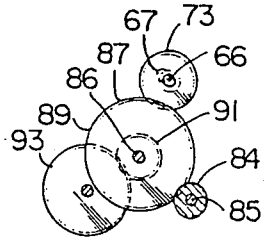
FIG. 7 is a partial cross section showing the meshing relationship of gears in the walking mechanism.
Figure 6:
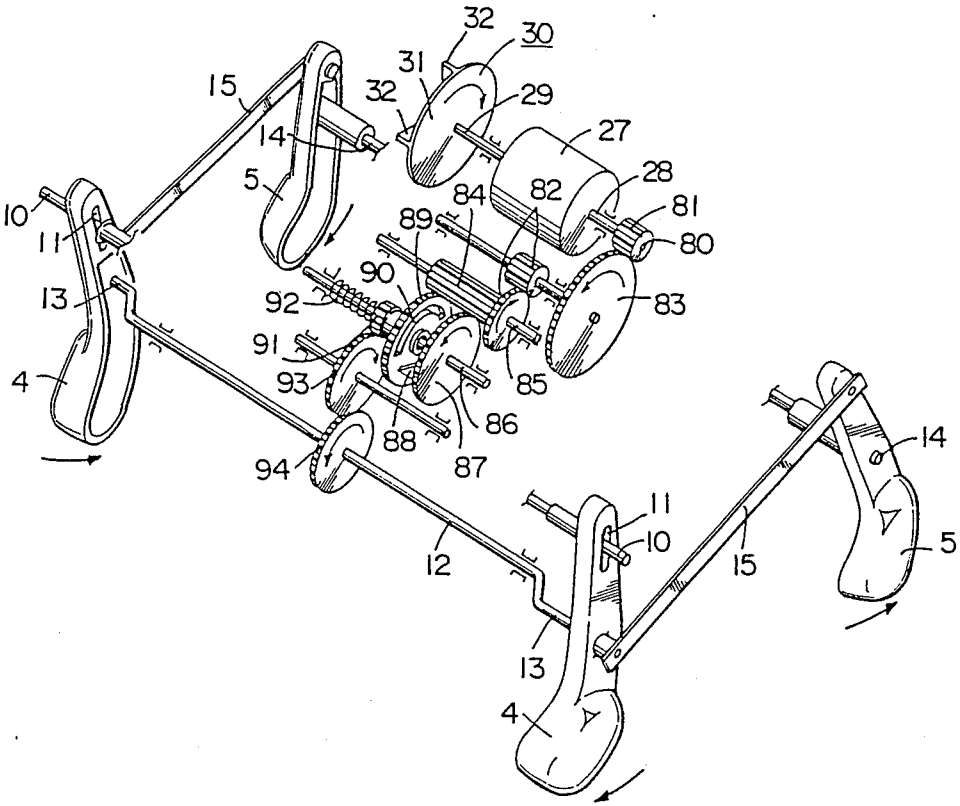
FIG. 6 is an exploded perspective view of a walking mechanism of the toy.
Figure 8:
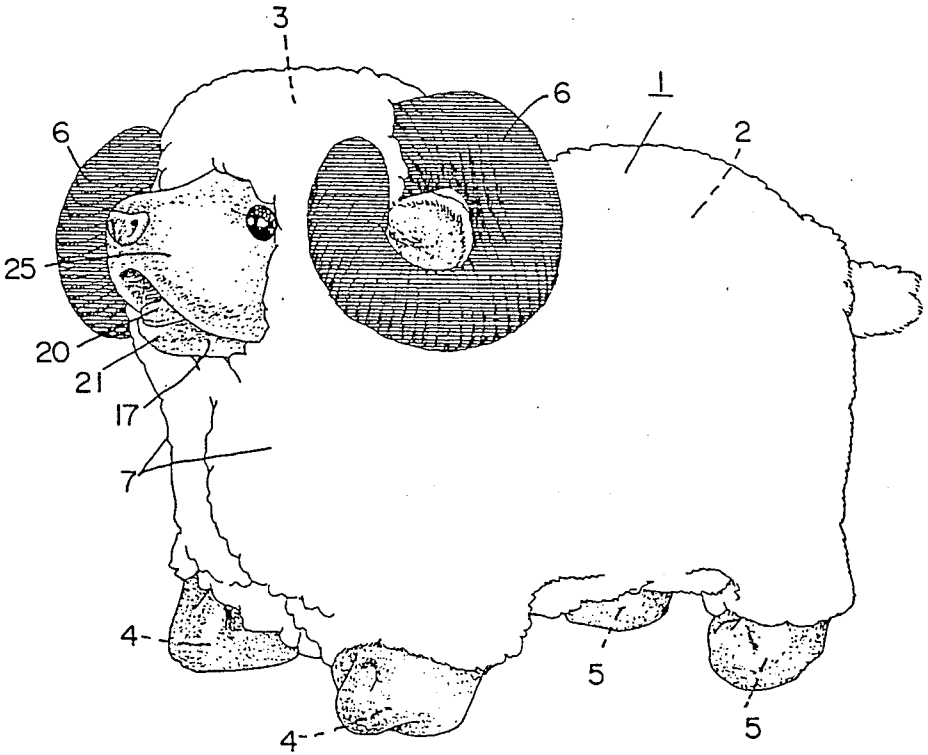
FIG. 8 is a perspective view of the toy.

In the attached drawings, reference numeral 1 denotes a toy body made in the likeness of an animal sheep. The toy body 1 consists of: a body frame 2 and a head frame 3, both divided into right and left halves that are bound together; left and right front leg frames 4, 4; left and right rear leg frames 5, 5; and a fluffy cover member 7 with horns 6 that covers the entire body of the toy.

In the body frame 2, a mechanism frame 8 and a battery case 9 connected to the mechanism frame 8 are longitudinally installed. In a front upper part of the mechanism frame 8 a lateral rod 10 is horizontally supported, with its ends inserted in vertically elongate guide slots 11, 11 formed in an upper part of the left and right front leg frames 4, 4. In the front lower part of the mechanism frame 8 a crankshaft 12 is rotatably installed and its crank arms 13, 13 are rotatably inserted in the front leg frames 4, 4 below the guide slots 11, 11. A bar 14 is horizontally installed at the rear lower portion of the battery case 9. The ends of the bar 14 are rotatably supported by upper portions of the left and right rear leg frames 5, 5. Connecting rods 15, 15 are installed between the crankshaft 12 and the rear leg frames 5, 5 on each side with the front and rear ends of the connecting rods rotatably connected to the crank arms 13, 13 of the crankshaft 12 and to the upper ends of the rear leg frames 5, 5.

A pair of opposing horizontal bearings 16, 16 is formed at the upper front end of the body frame 2 on each side. Between the right and left bearings 16, 16 is disposed a bearing 18 of a lower jaw frame 17 through which a support shaft 19 is inserted. The lower jaw frame 17 has a lower jaw 21 integrally attached to the front of the bearing 18 with a tongue 20 pasted to an upper surface of the lower jaw 21. An actuating plate 22 extending rearward from the bearing 18 has a longitudinal elongate guide slot 23 formed at its rear part. Rotatably mounted on the ends of the support shaft 19 is a lower portion of the head frame 3, on an upper part of which a bar 24 is horizontally supported. The lower jaw 21 is mounted vertically and oscillatably the support shaft 19 so that it is rotated with respect to an upper jaw 25 of the head frame 3 to open and close its mouth 26.

Rigidly installed in the mechanism frame 8 is a motor 27 whose output shaft 28 projects at its ends to the left and right. One projecting end 29 of the output shaft 28 is securely fitted with a fan 30, which consists of a disk 31 with many radial blades 32 protruding on the outer side. The fan 30 is rotatably installed in a blower chamber 34 of an air blower 33. The blower chamber 34 has many air suction slits 36 formed in its outer plate 35. Slidably mounted on the outer side of the outer plate 35 is an adjust plate 39 which has many communicating holes 37 that communicate with each of the air suction slits 36 and many blocking portions 38 that close the air suction slits 36. Support shafts 41, 41 projecting from front and rear portions of the air blower 33 are inserted into slots 40, 40 formed at front and rear portions of the adjust plate 39. The adjust plate 39 can be slid in the range defined by the slots 40, 40 and the support shafts 41, 41 contained therein. The air blower 33 is secured to one external side of the mechanism frame 8. On the rear side the air blower 33 has an air delivery chamber 42 of a reduced diameter, to the rear end of which an exhaust cylinder 44 with an exhaust passage 43 is hermetically connected. To the rear end of the exhaust cylinder 44 a voice amplifying cylinder 45 is also hermetically connected. At the front end of the exhaust cylinder 44 is formed a chamber 46 in which a cock 47 to block and permit the flow of air from the air delivery chamber 42 is rotatably installed. The cock 47 has a communicating hole 48 formed therethrough and also has a rotatable piece 49 securely attached to its outer end. In an exhaust portion 50 of the exhaust cylinder 44 a voice generating member 51 is installed airtight. The voice generating member 51 has a cylinder 52 installed airtightly in the exhaust portion 50. The cylinder 52 has a mounting hole 54 formed in an end plate 53 in which a voice generator 55 curved in semicircular shape is fitted. In the mounting hole 54 the voice generating member 51 also has a vibration piece 56 facing the voice generator 55. The voice generator 55 and the vibration piece 56 form a voice generating space 57 from which the vibrating sound is conveyed to the voice amplifying cylinder 45.

An actuating rod 58 is rotatably supported at one end on an upper part of the rotatable piece 49 through a support shaft 59. Rotatably connected to the other end of the actuating rod 58 is one crank arm 61 of a first crankshaft 60 which is horizontally and rotatably mounted in an upper intermediate portion of the mechanism frame 8. A coil spring 64 to pull backward the lower crank arm 62 of the crankshaft 62 is stretched between the second crank arm 62—which is 180° out of phase with the first crank arm 61—and a rod 63 projecting from a lower rear portion of the mechanism frame 8. Between the first crank arm 61 of the first crankshaft 60 and the bar 24 of the head frame 3, a spring bar 65 as a connecting rod is stretched with its ends so formed as to allow rotation of the bar and the crank arm. By the action of the coil spring 64 that pulls the second crank arm 62 rearward, the head frame 3 is kept at a specified position through the spring bar 65. As the first crankshaft 60 is rotated, the motion is transmitted through the spring bar 65 to the head frame 3 which then oscillates up and down about the support shaft 19.

In the upper intermediate portion of the mechanism frame 8 a second crankshaft 66 is rotatably and horizontally mounted. A crank arm 67 at one end of the second crankshaft 66 is rotatably inserted in a slot 69 which is formed in an upper front protruding part 68 of the adjust plate 39. Rotatably mounted on the second crankshaft 66 are a first intermediate gear 70 and its associate gear 71, both formed integral, for speed reduction. The gear 71 is in mesh with a reduction gear 72 securely mounted on the first crankshaft 60. The second crankshaft 66 also has an input gear 73 securely mounted at one end.

A voice making device 74 is made up of the motor 27, the wind blower 33 containing the fan 30, the exhaust cylinder 44 incorporating the cock 47, the voice amplifying cylinder 45 incorporating the voice generating member 51, the actuating rod 58, the first crankshaft 60, the adjust plate 39, and the second crankshaft 66.

In the front upper part of the mechanism frame 8 a third crankshaft 76 is rotatably and horizontally installed. The third crankshaft 76 has its crank arm 77 at one end rotatably inserted in the guide slot 23 of the actuating plate 22 of the lower jaw frame 17. A step-up gear 78 is rigidly mounted on the third crankshaft 76 at an intermediate portion and is in mesh with the first intermediate gear 70. The rotation of the third crankshaft 76 causes, through the actuating plate 22, the lower jaw 21 to vertically oscillate about the support shaft 19.

A pinion 81 is rigidly mounted on an other projecting part 80 of the output shaft 28 of the motor 27. Engaged with the pinion 81 is an input gear 83 of the gear mechanism 82 rotatably supported on the mechanism frame 8. An output gear 84 of the gear mechanism 82 is securely mounted on a shaft 85 which is rotatably and horizontally mounted on the mechanism frame 8.

A shaft 86 is rotatably and horizontally mounted on the mechanism frame 8, and on one end of the shaft 86 is rigidly mounted a first drive gear 87 that engages with the output gear 84 of the gear mechanism 82. On the outer side of the first drive gear 87 a switching claw 88 of a roughly triangular shape is axially projected.

Rotatably and axially slidably mounted on the shaft 86 is a second drive gear 89 which has a different number of teeth than that of the first drive gear 87 and is in meshing engagement with the output gear 84. The second drive gear 89 has an arc slot 90 formed near the outer periphery with which the switching claw 88 of the first drive gear 87 comes into or out of engagement.

Also on the shaft 86 a switching gear 91 which is formed integral with the second drive gear 89 is rotatably and axially slidably mounted. Between the outer side of the switching gear 91 and one side of the mechanism frame 8 is installed a coil spring 92 on the shaft 86 which urges the switching gear 91 and the second drive gear 89 toward the first drive gear 87. The switching gear 91 can be engaged with or disengaged from the first intermediate gear 70 on the second crankshaft 66.

In the front of the mechanism frame 8 a second intermediate gear 93 which can be brought into and out of engagement with the switching gear 91 is rotatably supported. The second intermediate gear 93 is also in mesh with a leg drive gear 94 which is securely mounted on an intermediate portion of the crankshaft 12 that supports the front leg frames 4, 4 on each side.

The motor 27 is connected, through a switch 96, to a battery 95 in the battery case 9. The switch 96 is provided to a cover 97 by which the battery case 9 is opened or closed.

Now, the action of the above construction will be explained.

When the switch 96 is closed, the motor 27 is started, rotating the pinion 81 and the fan 30. The rotation of the pinion 81 is transmitted, through the gear mechanism 82, to the output gear 84, which in turn drives the first drive gear 87 and the second drive gear 89. When the switching claw 88 of the first drive gear 87 is inserted in the switching slot 90 of the second drive gear 89, i.e., when the second drive gear 89 rotates close to the first drive gear 87, the switching gear 91 urged by the coil spring 92 is engaged with the first intermediate gear 70 to rotate the gear 70 and at the same time the second drive gear 89 engages with the input gear 73 which is then rotated by it.

The rotation of the first intermediate gear 70 is transmitted, through the associate gear 71 which is integral with the gear 70, to the reduction gear 72, with the result that the first crankshaft 60 rotates at a specified reduced speed against the force of the coil spring 64. As the first crankshaft 60 rotates, the crank arm 61 at one end pulls and releases the spring bar 65 longitudinally, causing the head frame 3 to vertically oscillate about the support shaft 19. As a result, the face portion 3*a* on the head frame 3 is slowly oscillated up and down.

The intermediate gear 70 also drives the stepup gear 78 which rotates the third crankshaft 76 at a higher revolution speed. As the crank arm 77 rotates, the actuating plate 22 of the lower jaw frame 17 is oscillated vertically about the support shaft 19, causing the lower jaw to oscillate up and down at a higher speed than that of the vertical oscillation of the head frame 3.

Thus, by the slower rotation of the first crankshaft 60, the head frame 3 is oscillated up and down to make the face portion 3*a* slowly move upward and downward. At the same time, by the accelerated rotation of the third crankshaft 76, the lower jaw 21 is oscillated up and down at a small pitch with respect to the upper jaw 25. The combination of the slow vertical oscillation of the head frame 3 and the high-pitched vibration of the lower jaw 21 makes the toy body 1 appear as if it were repetitively opening and closing its mouth 26.

In addition to producing the advancing and retracting motion of the spring bar 65, the rotation of the crankshaft 60 causes, through the first crank arm 61, the actuating rod 58 to advance and retract longitudinally. This in turn causes, through the rotatable piece 49, the cock 47 in the chamber 46 to be reciprocally turned forward and backward through a specified angle, opening and closing the communication hole 48 between the air delivery chamber 42 and the exhaust passage 43.

When the input gear 73 is rotated, the second crankshaft 66 is also rotated. The rotation of the crank arm 67 causes the adjust plate 39 to slide back and forth in the range of the slots 40, 40 with respect to the support shafts 41, 41, with the result that the air suction slits 36 in the outer plate 35 of the blower chamber 34 are opened and closed by the communication holes 37 and the blocking portions 38 of the adjust plate 39.

As the fan 30 is turned by the motor 27, the open air is drawn in through the air suction slits 36 of the blower chamber 34 and then delivered from the blower chamber 34 into the air delivery chamber 42 from which it is further fed through the communicating hole 48 of the cock 42 in the exhaust cylinder 44 to the exhaust passage 43. When the air is blown from the communicating hole 48 of the cock 47 to the exhaust passage 43, the voice generating member 51 produces a specified sound which is magnified and released outside by the voice amplifying cylinder 45.

In the above process, when drawing the open air into the blower chamber 34 by the fan 30, the air suction slits 36 of the outer plate 35 are opened and closed by the communicating holes 37 and the blocking portions 38 of the adjust plate 39 which is advanced and retracted by the rotation of the second crankshaft 66. This means that the amount of air drawn into the blower chamber 34 is automatically regulated and this in turn automatically adjusts the amount of air supplied from the air delivery chamber 42 to the exhaust passage 43.

When the air is supplied from the air delivery chamber 42 to the exhaust passage 43, the cock 47 is reciprocally rotated back and forth by the rotating first crankshaft 60 through the actuating rod 58 and the rotating piece 49. As the result of the reciprocal rotation of the cock 47, the communicating hole 48 of the cock 47 is opened at one time to the exhaust passage 43 and is closed at the other by being turned to a position where it is perpendicular to the air flow into the exhaust passage 43. In this way, the reciprocal rotation of the cock 47 slowly and automatically regulates the amount of air supplied to the voice generating member 51, producing small-pitched pulsating changes in the air flow and flow speed.

The pulsations in the air flow and flow speed in turn produce vibrations or fluctuations in the voice generated by the vibration piece 56 of the voice generating member 51.

Therefore, according to the air flow controlled by the adjust plate 39 and the cock 47, the voice intensity and quality produced by the voice generating member 51 varies. And the voice thus produced has good vibrations and sounds like that of a real sheep.

In summary, the toy body 1 vibratingly opens and closes its mouth 26 through the combination of the slow vertical oscillation of the head frame 3 and the small-pitched vibration of the lower jaw 21, while at the same time generating a voice by the voice making device 74. When the head frame 3 is oscillated upward, a high-tone voice with good vibrations is sounded to match the upward looking posture. When it is oscillated downward, a low-tone voice with good vibrations is sounded to match the downward looking posture. With this coordination between the head and lower jaw motion and the tone change in voice, the toy body 1 appears as if the real sheep were baaing in a changing tone with its face slowly inclining up and down and with its mouth opening and closing at small intervals.

The output gear 84 drives the first drive gear 87 and the second drive gear 89. As the switching claw 88 of the first drive gear 87 gradually moves out of the switching arc slot 90 of the second drive gear 89 because of the difference in the teeth number between the first and the second drive gears 87, 89, the second drive gear 89 and its switching gear 91 is gradually pushed axially against the coil spring 92. When the front end of the switching claw 88 disengages from the switching arc slot 90 and then comes into sliding engagement with the side of the second drive gear 89, the second drive gear 89 disengages from the input gear 73 and the rotation of the second crankshaft 66 stops. At the same time, the switching gear 91 that is pushed axially against the coil spring 92 by the second drive gear 89 disengages from the first intermediate gear 70, stopping the rotation of the first crankshaft 60 and the third crankshaft 76. The switching gear 91 that has parted from the first intermediate gear 70 now comes into mesh with the second intermediate gear 93 to rotate the leg drive gear 94.

Since the first, second and third crankshafts 60, 66, 76 stop rotating, the toy body 1 stops the associated actions.

When the leg drive gear 94 is rotated by the switching gear 91, the crankshaft 12 is rotated to cause, through the crank arms 13, 13 at each end, the front leg frames 4, 4 on each side to oscillate back and forth about the ends of the shaft 10. The back and forth oscillation of the front leg frames 4, 4 in turn oscillates the rear leg frames 5, 5 on each side back and forth about the ends of the shaft 14.

After the actions associated with the first through third crankshafts are stopped, the toy body 1 starts walking slowly ahead for a specified period of time.

In the meantime, the output gear 84 continues driving the first drive gear 87 and the second drive gear 89. When the switching arc groove 90 of the second drive gear 89 becomes aligned with the switching claw 88 of the first drive gear 87, the switching gear 91 and the second drive gear 89 are moved axially toward the first drive gear 87 by the force of the coil spring 92, causing the switching claw 88 of the first drive gear 87 to come into the switching arc slot 90 of the second drive gear 89. As a result the first drive gear 87 and the second drive gear 89 are rotated close together. This in turn brings the second drive gear 89 into meshing engagement with the input gear 73, and at the same time the switching gear 91 disengages from the second intermediate gear 93 and engages with the first intermediate gear 70 again. The instant the switching gear 91 disengages from the second intermediate gear 93, the toy body 1 stops walking. And when the switching gear 91 comes into engagement with the first intermediate gear 70 and the second drive gear 89 engages with the input gear 73, the toy body 1 again starts performing the bleating action.

[Effect of the Invention]

According to this invention, the open air is taken in by the fan and the air flow is adjusted by the cock and supplied to the voice generating member with a vibrating piece. This makes it possible to produce a voice that has good vibration and changing quality and intensity. The sound thus produced is very much like the baaing voice characteristic of the sheep with complex tone and quality. Thus, this invention provides a voice making device or baaing device capable of producing a voice with interesting rhythms and tones.

Furthermore, in time to the tone changes of the voice generated by the voice making device, the toy sheep moves its head up and down with its mouth opened and closed at short intervals. This combined action makes the toy body look as if the real sheep were baaing in a characteristic voice while slowly moving its head up and down and vibrating its mouth. Because of the well coordinated baaing and associated actions, the invention provides a very interesting moving animal toy.

What is claimed is:

1. A voice making device for a moving animal toy comprising an air blower having a fan rotatably installed in a blower chamber with air suction slits, the air blower also having a voice generating member with a vibrating piece installed in an exhaust portion of an exhaust passage communicating with the blower chamber; a cock rotatably installed between the blower chamber and the exhaust passage to control an air flow supplied to the voice generating member; and an adjust plate installed rotatably with respect to the air suction slits of the blower chamber, the adjust plate having communicating holes and blocking portions to open and close the air suction slits and thereby regulate an amount of external air drawn into the blower chamber; motor means for moving said animal toy, said motor means also for operating said cock, said fan, and said adjust plate.

2. A moving animal toy comprising a body frame; a head frame mounted vertically and oscillatably at the front end of the body frame through a support shaft; a lower jaw frame mounted vertically and oscillatably on the support shaft to cooperate with an upper jaw of the head frame; the body frame, the head frame and the lower jaw frame constituting a toy body; a mechanism frame installed in the body frame of the toy body; an air blower mounted to the mechanism frame and comprising of a fan and a voice generating member, the fan being rotatably mounted in a blower chamber having air suction slits, and the voice generating member having a vibration piece in an exhaust portion of an exhaust passage communicating with the blower chamber; a cock rotatably installed between the blower chamber and the exhaust passage to control an air flow supplied to the voice generating member; an adjust plate installed rotatably movable with respect to the air suction slits of the blower chamber, the adjust plate having communicating holes and blocking portions to open and close the air suction slits and thereby regulate an amount of external air drawn into the blower chamber; a first crankshaft mounted rotatable on the mechanism frame to vertically oscillate the head frame through a connecting rod and also to rotate the cock through an actuating rod; a second crankshaft rotatably mounted on the mechanism frame to advance and retract the adjust plate; a third crankshaft rotatably mounted on the mechanism frame to vertically oscillate the lower jaw frame at small pitches; and a motor rigidly mounted to the mechanism frame and having the fan secured to one end of its output shaft, the other end of the motor output shaft being in mesh with a gear mechanism to drive the first, second and third crankshafts.

* * * * *